US005333486A

United States Patent [19]

Ishihara

[11] Patent Number: 5,333,486

[45] Date of Patent: Aug. 2, 1994

[54] SHEET METAL DRAWING EQUIPMENT

[76] Inventor: Kosei Ishihara, No. 2221-10, Nekoyamachi, Takasaki-shi, Gunma-ken, Japan

[21] Appl. No.: 979,839

[22] Filed: Nov. 23, 1992

[30] Foreign Application Priority Data

Nov. 24, 1991 [JP] Japan ..... 3-104265[U]

[51] Int. Cl.[5] ..... B21D 1/12

[52] U.S. Cl. ..... 72/391.2; 72/705

[58] Field of Search ..... 72/391.2, 705, 450

[56] References Cited

U.S. PATENT DOCUMENTS

| | | | |
|---|---|---|---|
| 3,801,772 | 4/1974 | Curcio et al. | 72/705 |
| 4,037,448 | 7/1977 | Di Maio . | |
| 4,050,271 | 9/1977 | Jones . | |
| 4,089,201 | 5/1978 | Raptis | 72/705 |
| 4,116,035 | 9/1978 | Malarsky . | |
| 4,376,385 | 3/1983 | Davis . | |
| 4,914,942 | 4/1990 | Ishihara | 72/463 |
| 4,930,335 | 6/1990 | Ishihara | 72/451 |

FOREIGN PATENT DOCUMENTS

| | | | |
|---|---|---|---|
| 8618109 | 12/1986 | Fed. Rep. of Germany . | |
| 132222 | 6/1986 | Japan | 72/705 |

*Primary Examiner*—Lowell A. Larson

*Attorney, Agent, or Firm*—Price, Gess, & Ubell

[57] ABSTRACT

A sheet metal drawing equipment capable of rapidly and positively carrying out sheet metal drawing without skill and effectively smoothing a surface of a sheet metal material. The equipment includes a first operation mechanism provided with at a distal end thereof with a bit weldable to a surface of a sheet metal material to be drawn, a second operation mechanism manually operated to pull up the first operation mechanism, and a leg structure for supporting the second operation mechanism. The second operation mechanism includes a support section for rotatably supporting the first operation mechanism.

23 Claims, 22 Drawing Sheets

SHEET METAL DRAWING EQUIPMENT

BACKGROUND OF THE INVENTION

1. Field of the Invention

This invention relates to a sheet metal drawing equipment, and more particularly to a sheet metal. drawing equipment which is adapted to carry out a sheet metal drawing operation while finely controlling application of force to a tip end of a bit welded to a sheet metal material.

2. Description of Related Art

A sheet metal drawing equipment which is adapted to draw any depression formed on a surface of a sheet metal material by means of a fixture or tool welded to the surface, to thereby smooth the surface has been conventionally known in the art. Such a conventional sheet metal drawing equipment of a first type is a slide hammer type which is generally constructed as shown in FIGS. 1 and 2. More particularly, the sheet metal drawing equipment includes a tool 500 to be welded to a surface 400 of a sheet metal material and a hook temporarily held on one end of the tool, so that the surface of the sheet metal is drawn by shock. Also, a conventional sheet metal drawing equipment of a second type is proposed in Japanese Utility Model Publication No. 27290/1987 (62-27290) by the same applicantas that of the present invention.

Further, a conventional sheet metal drawing equipment of a third type is proposed, which is constructed as shown in FIG. 3. More particularly, an equipment generally designated at reference numeral 800 is a slide hammer type which is fed with a weak current to weld a tip end of a bit to a surface of a sheet metal material. For this purpose, the equipment 800 is provided at a distal end thereof with a bit 825 which is kept welded to the surface during drawing. Also, the equipment 800 includes a grip section 810 provided therein with an electrode and a body section 820 having a slide hammer 821, which are connected to each other by means of a screw 830. The bit 825 is fed with an electric current, resulting in being welded to the surface of the sheet metal material. Then, the slide hammer 821 is slid to generate shock, so that a depression on the surface of the sheet metal material may be drawn.

Unfortunately, the equipment of the first type causes shock generated by the hook to separate the tool 500 kept welded to the surface 400 therefrom during drawing. Also, it carries out drawing while applying force due to the shock to the tool 500, so that the surface of the sheet metal material which has been drawn tends to be roughed. Further, in the first type, it is highly difficult to adjust force applied to the tool during drawing, to thereby cause excessive drawing. Moreover, it is substantially impossible to carry out drawing sufficient to smooth the surface of the sheet metal material in a short period of time.

The equipment of the second type is conveniently applied to rough drawing wherein force required for drawing is transmitted through a tool to a surface of a sheet metal material to draw the sheet metal material over a relatively large area at a stroke. However, it is not suitable for carrying out drawing while finely applying force to the tool as in fine drawing which is required after the rough drawing, drawing carried out on a small area, drawing carried out on a very specific place or the like.

In the equipment of the third type, the grip section 810 is kept fixedly connected to the body section 820 by means of the screw 830 during drawing. However, shock occurring due to operation of the hammer causes damage to the electrode, a failure of a switch means 811, looseness of connection between the grip section 810 and the body section 820 and the like, leading to a failure in satisfactory electrical contact. Also, connection between the grip section 810 and the body section 820 requires to use the screw, resulting in being highly troublesome. Furthermore, the equipment causes selection of a position and a direction which facilitate handling of the tool to be substantially restricted, because the grip section 810 and body section 820 are fixed to each other using the screw 830 and a cord 840 is arranged on the side of the grip section.

SUMMARY OF THE INVENTION

The present invention has been made in view of the foregoing disadvantages of the prior art.

Accordingly, it is an object of the present invention to provide a sheet metal drawing equipment which is capable of permitting smoothing of a surface of a sheet metal material to be readily accomplished while ensuring rapid and effective sheet metal drawing without substantially requiring skill.

It is another object of the present invention to provide a sheet metal drawing equipment which is capable of facilitating metal sheet drawing irrespective of conditions of a surface portion of a sheet metal material to be drawn.

It is a further object of the present invention to provide a sheet metal drawing equipment which is capable of previously setting optimum drawing conditions for drawing a depression on a surface of a sheet metal material and permitting a worker to carry out sheet metal drawing while visually monitoring the surface of the sheet metal material being drawn.

It is still another object of the present invention to provide a sheet metal drawing equipment which is capable of substantially reducing production of metal fatigue on a portion of a sheet metal material drawn.

It is yet another object of the present invention to provide a sheet metal drawing equipment which is provided with a clamp-type connector capable of exhibiting suitable electrical connection.

In accordance with the present invention, a sheet metal drawing equipment is provided. The equipment includes a first operation means provided at a distal end thereof with a bit weldable to a surface of a sheet metal material to be drawn, a second operation means including a support section for rotatably supporting the first operation means and manually operated to pull up the first operation means, and a leg means for supporting the second operation means.

In the sheet metal drawing equipment of the present invention thus constructed, a tip end of the bit is welded to a surface of a sheet metal material to be drawn and then the second operation means is manually gripped to pull up the second lever against a coiled compression spring, so that the surface of the sheet metal material may be slowly drawn up, resulting in being smoothed. Then, the handle is rotated to separate the tip end of the bit from the surface of the sheet metal material.

In accordance with a preferred embodiment of the present invention, a sheet metal drawing equipment is provided. The equipment includes a first operation means provided at a distal end thereof with a bit weldable to a surface of a sheet metal material to be drawn and formed with a connection section for connecting an output cord of a welding machine to the first operation means therethrough; a second operation means including a support section for rotatably supporting the first operation means and manually operated to pull up the first operation means; and a clamp-type connector including a first clamp means, a second clamp means pivotally connected to the first clamp means, a spring for urging a distal end of the second clamp means toward a distal end of the first clamp means, and a cord connected to one of the first clamp means and second clamp means, wherein the distal ends of the first and second clamp means cooperate with each other to form a clamper, through which the clamp-type connector is detachably connected to the connection section of the first operation means.

In the embodiment of the present invention thus constructed, the first clamp means and second clamp means are moved so as to be apart from each other against the spring, so that the clamp-type connector may be fitted on the connection section such as a shaft of the sheet metal drawing equipment to ensure stable electrical connection between the connector and the equipment. The clamper constituted by the first and second clamp means pivotally connected to each other may be pivotally moved while being mounted on the equipment.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENTS

Figure 1:
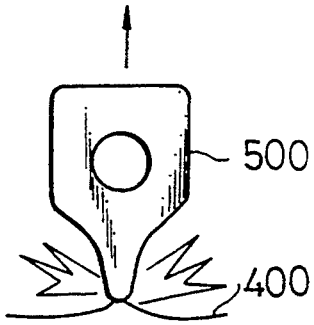
FIG. 1 PRIOR ART
FIG. 1 is a front elevation view showing sheet metal drawing by means of a tool used in a conventional sheet metal drawing equipment of one type.
Figure 2:
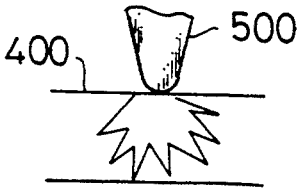
FIG. 2 PRIOR ART
FIG. 2 is a front elevation view showing a tip end of the tool shown in FIG. 1 which has been welded to a surface of a sheet metal material to be drawn.
Figure 3:
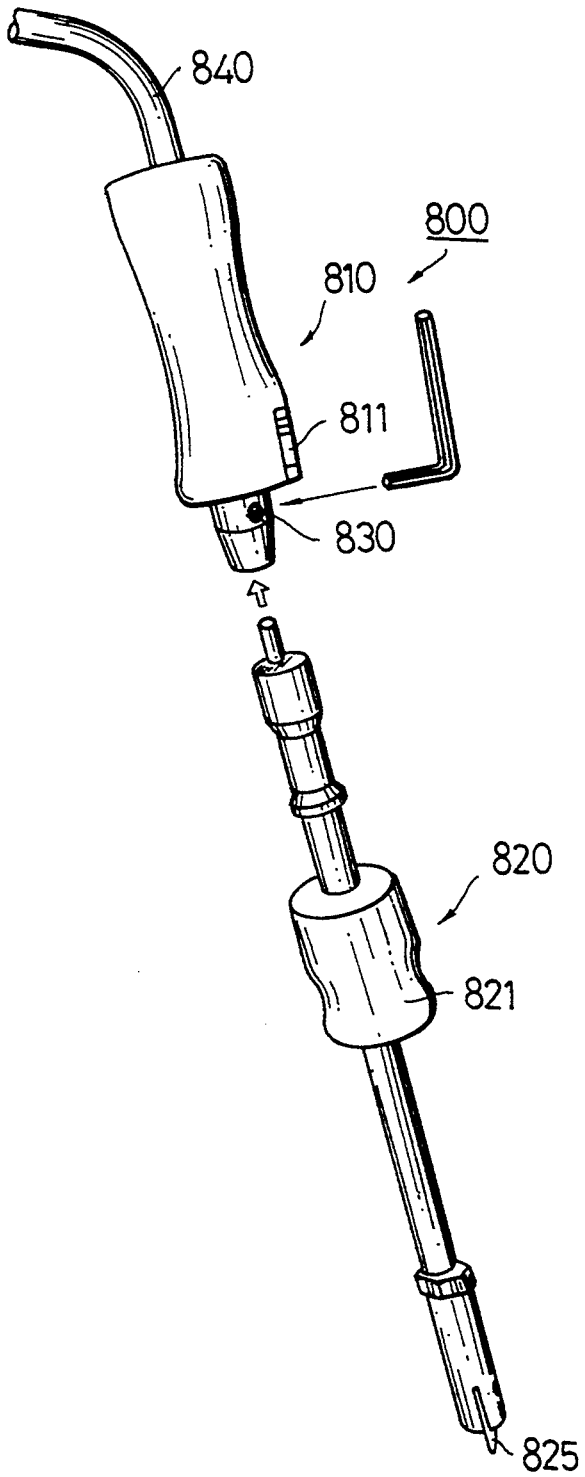
FIG. 3 PRIOR ART
FIG. 3 is a perspective view showing a conventional sheet metal drawing equipment of another type.

Now, a sheet metal drawing equipment according to the present invention will be described hereinafter with reference to FIGS. 4 to 28.

Referring first to FIGS. 4 to 11, an embodiment of a sheet metal drawing equipment according to the present invention is illustrated. A sheet metal drawing equipment of the illustrated embodiment is generally designated at reference numeral 1 and generally includes a first operation means 10 provided at a distal end thereof with a bit 15 which is weldable to a surface of a sheet metal material to be drawn, a second operation means 20 including a support section 50 for rotatably supporting the first operation means 10 and manually operated so as to pull up or draw up the first operation means 10, and a leg means 90 for supporting the second operation means 20 thereon.

Figure 7:
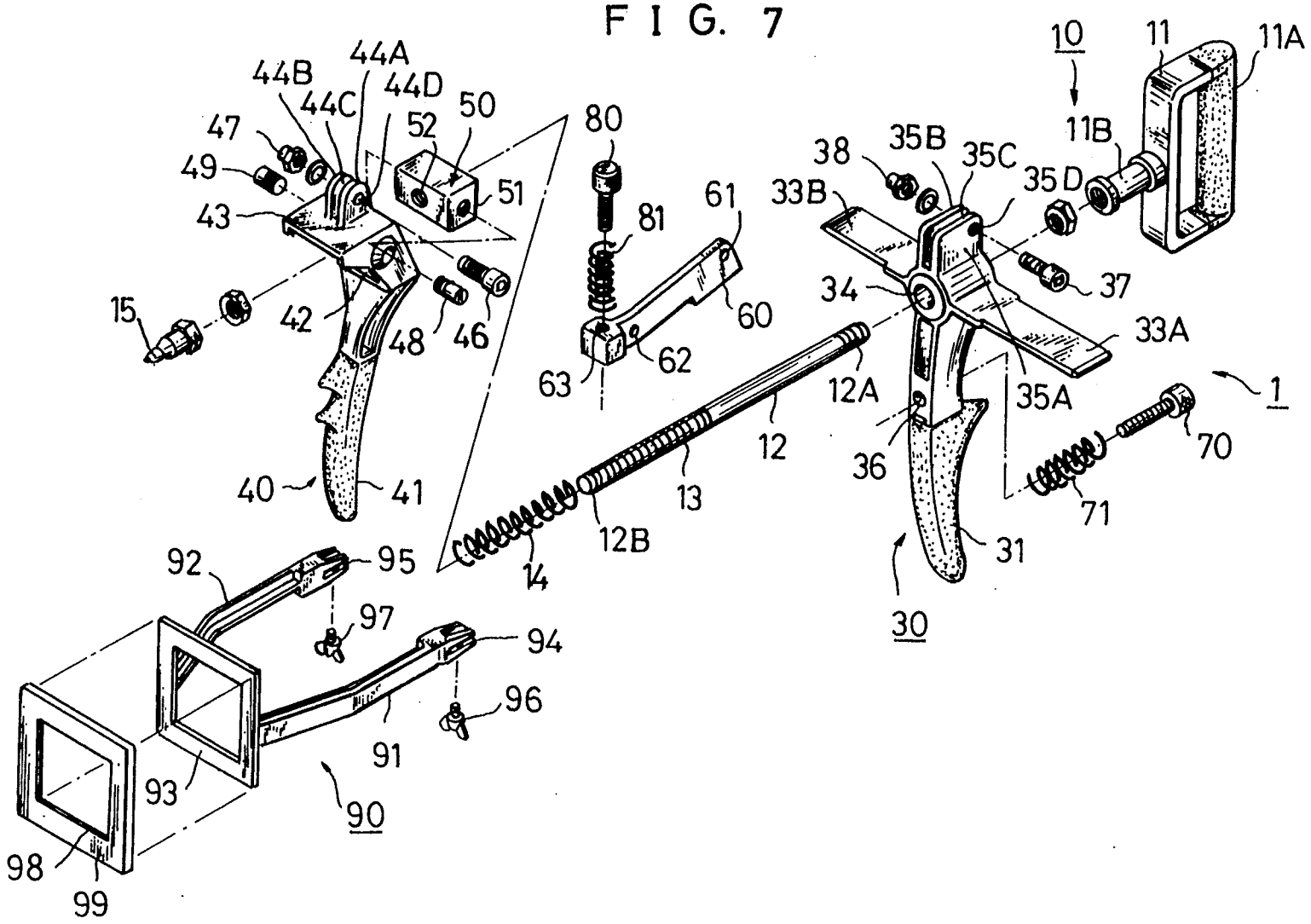
FIG. 7 is an exploded perspective view showing parts of the sheet metal drawing equipment shown in FIG. 4.
Figure 8:
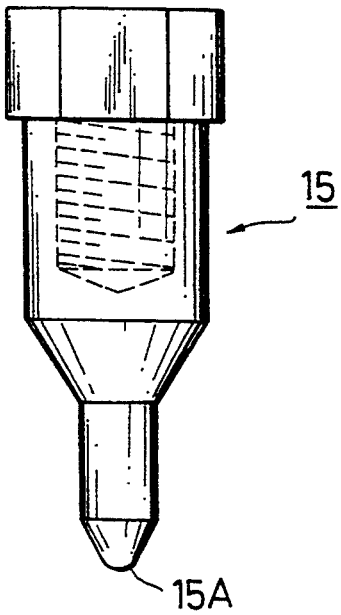
FIG. 8 is a front elevation view showing a bit arranged on a distal end of the sheet metal drawing equipment shown in FIG. 4.
Figure 9:
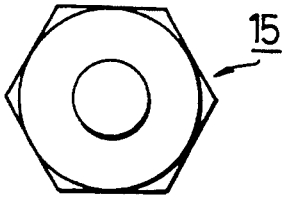
FIG. 9 is a bottom view of the bit shown in FIG. 8.

The first operation means 10 includes a shaft 12 and a handle 11 provided on a proximal end 12A of the shaft 12 for rotating the shaft 12. The bit 15 is arranged at a distal end 12B of the shaft 12. The shaft 12 of the first operation means 10, as shown in FIG. 7, is threadedly fitted at the one or proximal end 12A thereof in a threaded hole of a cord connection 11B provided on the handle 11 so as to project therefrom and threadedly inserted at the other or distal end 12B into a threaded hole formed at a proximal end of the bit 15. The shaft 12 is formed on a portion extending from an intermediate portion thereof to the distal end thereof with threads 13, which are threadedly inserted through the support section 50 of the second operation means 20 described hereinafter, so that the first operation means 10 may be rotatably supported on the second operation means 20. The shaft 12 has a coiled compression spring 14 fitted thereon. The handle 11 includes a grip 11A covered with an insulating material.

The second operation means 20 includes a first or main lever 30, a second lever 40, and a connection arm 60 for connecting the main lever and second lever 40 to each other therethrough. The main lever 30 includes a handgrip 31 covered with an insulating material, an arm beam or support beam including a pair of arm portions 33A and 33B connected to the handgrip 31 so as to laterally extend therefrom in a direction perpendicular to the handgrip 31 and supported on the leg means 90, and a pair of projections 35A and 35B mounted on a central portion of the arm beam so as to outward extend in parallel to each other therefrom with a groove 35C being defined therebetween. In the illustrated embodiment, the projections 35A and 35B are arranged so as to extend in a direction perpendicular to the arm beam. The arm beam is formed at a central portion thereof with a through-hole 34 via which the shaft 12 is inserted. The second lever 40 includes a handgrip 41 covered with an insulating material as in the handgrip 31, which is provided at a portion thereof in proximity to a distal end portion thereof with a cutting 42. The support section 50 constitutes a part of the second lever 40 and is arranged in the cutting 42 to support the first operation means 10. The second lever 40 also includes a pair of projections 44A and 44B mounted on the distal end of the handgrip 41 so as to outward extend in parallel with each other with a groove 44C being defined therebetween. In the illustrated embodiment, the projections 44A and 44B are arranged on an end plate 43 mounted on the distal end of the handgrip 41. The support section 50 includes a support member 51 formed at a central portion thereof with a threaded through-hole 52 and received in the cutting 42. The support member 51 is mounted on the second lever 40 by means of screws 48 and 49 so as to permit the support member 51 and second lever 40 to be rotatable relative to each other. Thus, the through-hole 52 of the support member 51 and the threaded portion 13 of the shaft 12 are threadedly engaged with each other, so that the first operation means 10 is rotatably supported on the second operation means 20.

The connection arm 60 is formed at upper and lower portions thereof with through-holes 61 and 62 via which bolts are inserted, respectively. The connection arm 60 is mounted at the upper portion thereof in the groove 35C of the main lever 30 by means of a combination of a nut 38 and a bolt 37 inserted via the through-hole 61 of the arm 60 and through-holes 35D formed via the projections 35A and 35B. Also, the connection arm 60 is mounted at the lower portion thereof in the groove 44C of the second lever 40 by means of a combination of a nut 47 and a bolt 46 inserted via the through-hole 62 of the arm 60 and through-holes 44D formed via the projections 44A and 44B. Thus, the main lever 30 and second lever 40 are operatively and mechanically connected to each other through the connection arm 60, wherein the second lever 40 is pivotally supported on the connection arm 60 about the bolt 46 inserted via the through-hole 62.

Figure 4:
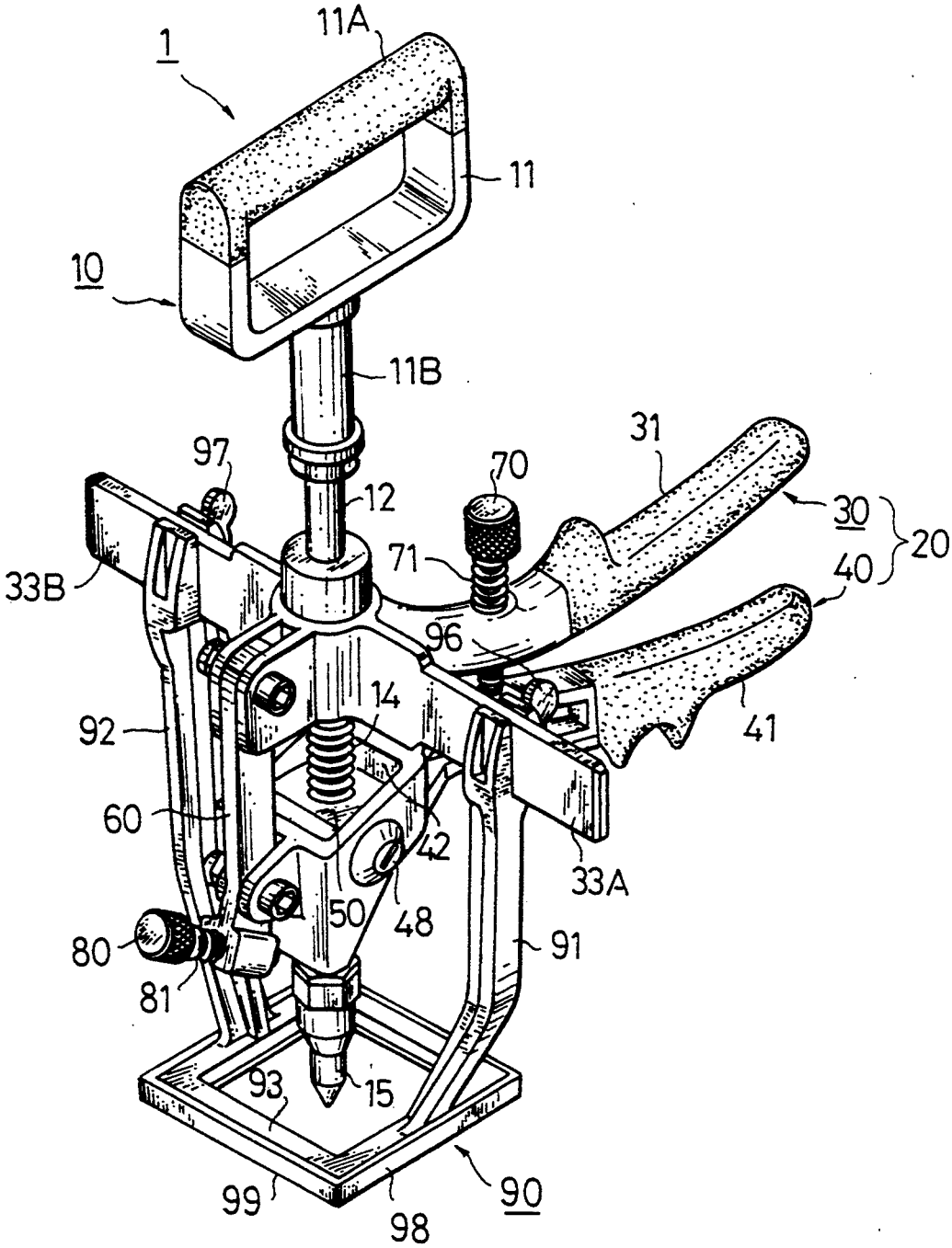
FIG. 4 is a perspective view generally showing an embodiment of a sheet metal drawing equipment according to the present invention.
Figure 5:
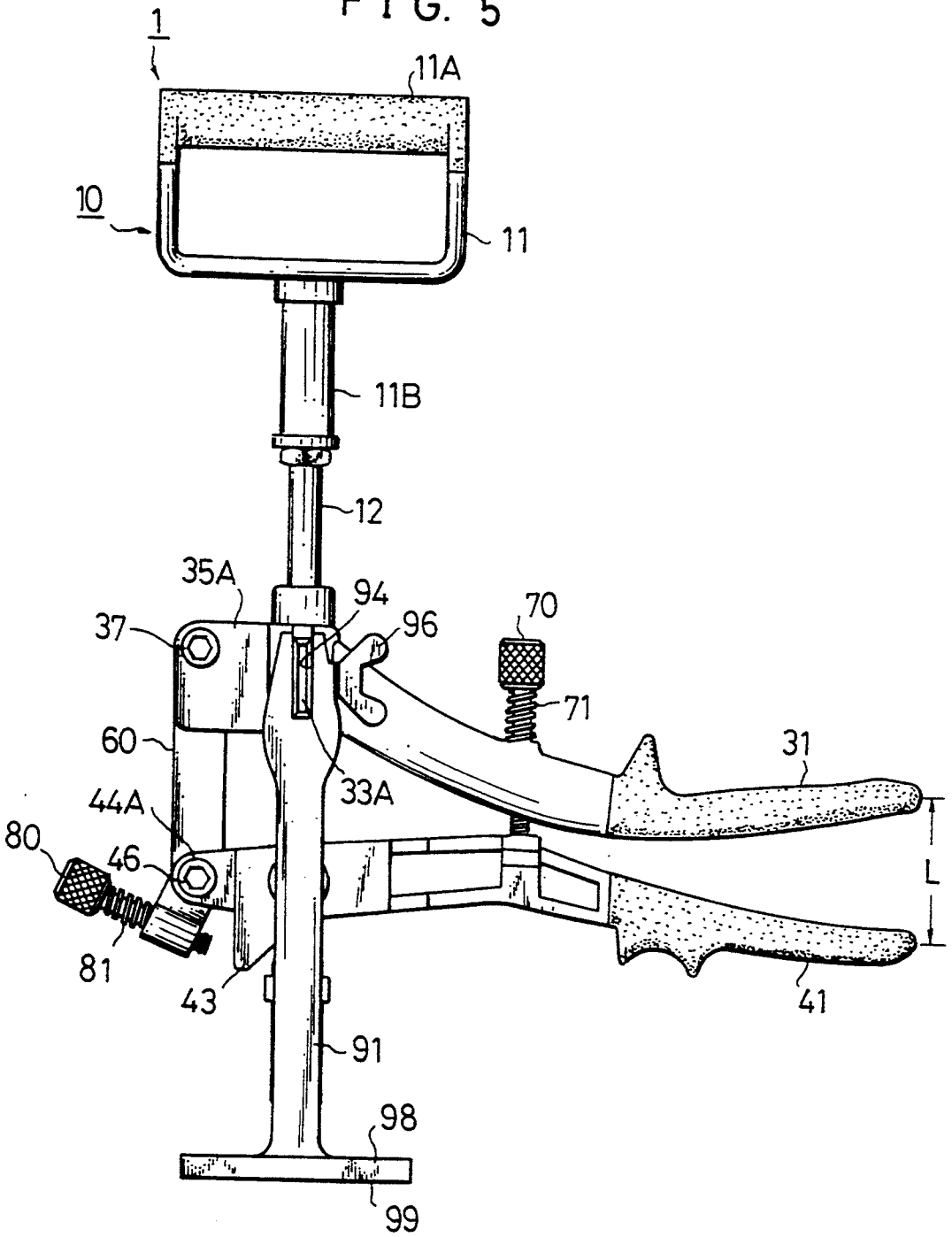
FIG. 5 is a side elevation view of the sheet metal drawing equipment shown in FIG. 4.
Figure 6:
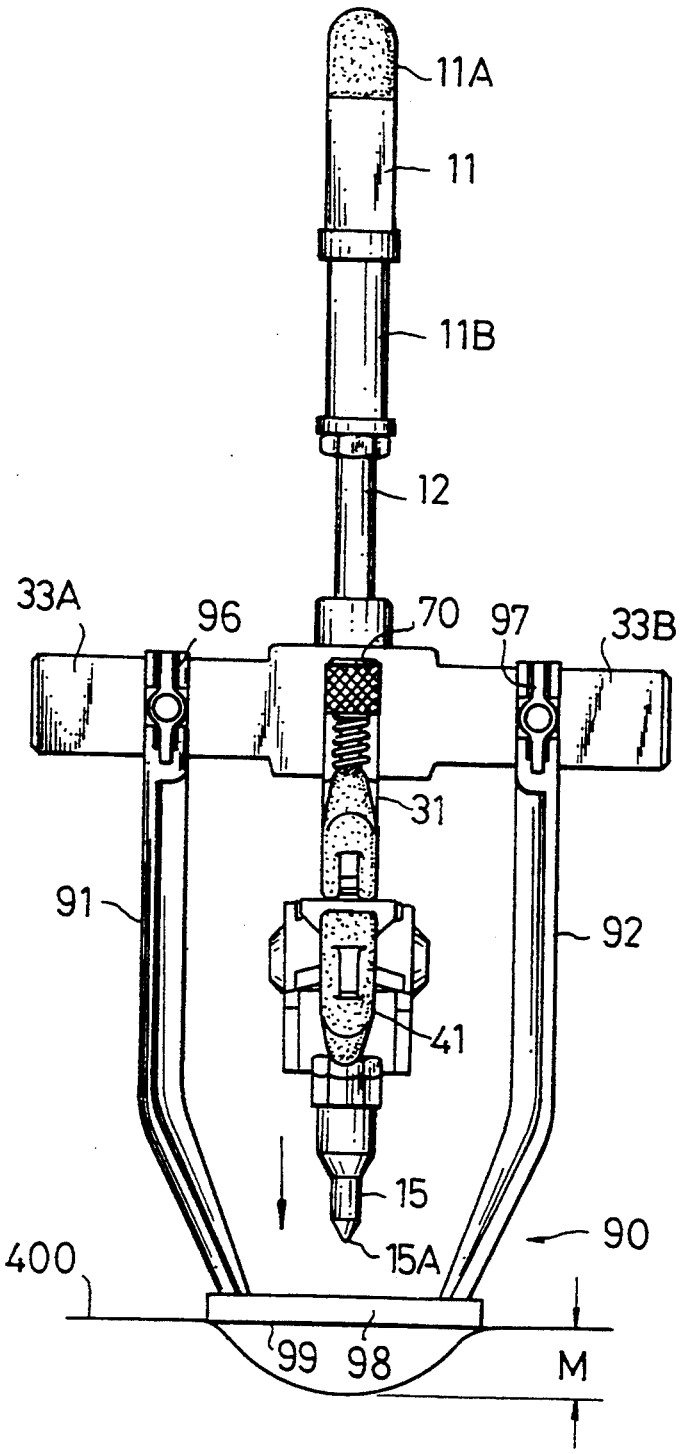
FIG. 6 is a front elevation view of the sheet metal drawing equipment shown in FIG. 4.

The coiled compression spring 14 is arranged between the main lever 30 and a top surface of the support section 50 while being fitted on the shaft 12, so that the second lever 40 may be constantly forced in a downward direction in FIGS. 4 to 6. A stopper 70 is so arranged that it is abutted against an upper surface of the second lever 40 when the second lever 40 is manually pulled up, to thereby prevent the second lever 40 from being excessively upward moved or pulled up. The stopper 70 comprises a bolt 70 and a coiled spring 71 fitted thereon and is threadedly inserted in a threaded hole 36 formed at a portion of the main lever 30 in proximity to the handgrip 36. Reference numeral 80 designates a bolt for adjusting a grip width, which is threadedly inserted via a threaded through-hole 63 formed at the lower portion of the connection arm 60 while having a coiled spring 81 fitted thereon and is abutted at a distal end thereof against the side end surface 43 of the second lever 40. A degree of insertion of the grip width adjusting bolt 80 through the threaded hole 63 is suitably selected, so that a grip width or span L (FIG. 5) between the main lever 30 and the second lever 40 may be adjusted to a degree sufficient to fit an operator.

The leg means 90 includes an annular contact member 93, a pair of legs 91 and 92 mounted on the contact member 93 so as to upward extend therefrom, and an annular cushion member 98 formed so as to surround the contact member 93, so that the contact member 93 and cushion 98 cooperate with each other to form a contact section 99 adapted to be abutted against a surface of a sheet metal material to be drawn. The legs 91 and 92 are provided at upper portions thereof with guide grooves 94 and 95, respectively, in which arms portions 33A and 33B of the arm beam of the main lever 30 are fittedly fixed by means of screws 96 and 97, respectively. In the illustrated embodiment, the contact member 93 and the cushion member 98 each are formed into a rectangularly annular shape.

Figure 10:
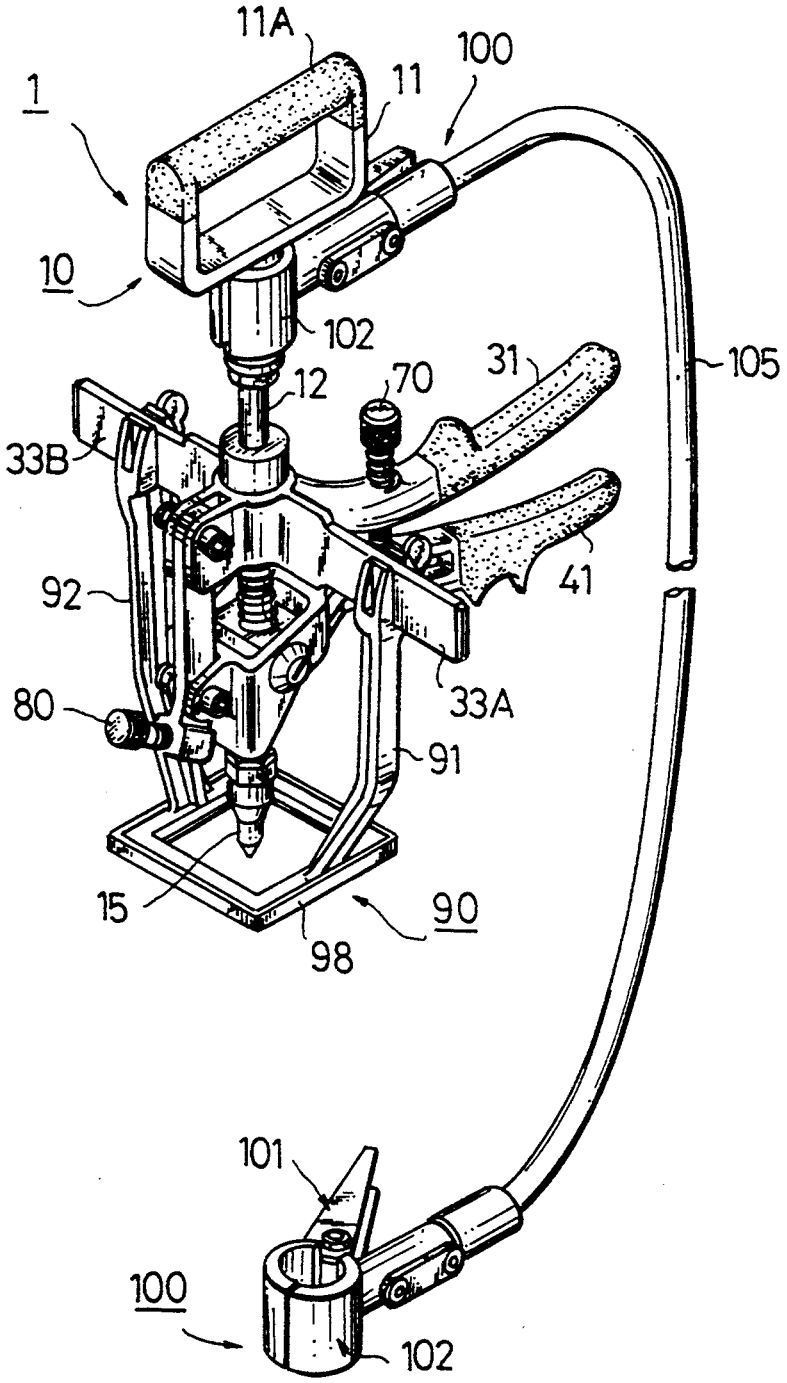
FIG. 10 is a perspective view of the sheet metal drawing equipment shown in FIG. 4, in which a clamp-type connector is connected at one end thereof to a cord connection of the sheet metal drawing equipment.
Figure 11:
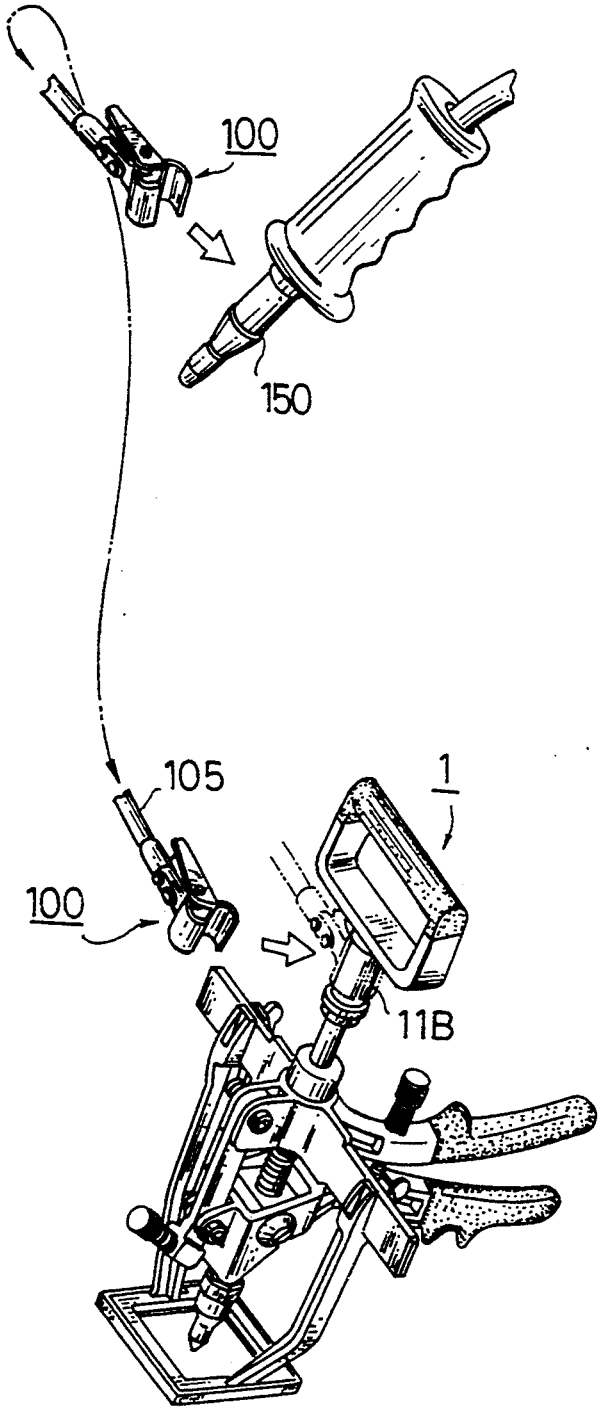
FIG. 11 is a perspective view showing the manner of connection of the sheet metal drawing equipment of FIG. 4 to a stud welding machine through a power cord.

Then, as shown in FIGS. 10 and 11, a clamp-type connector 100 mounted on one end of a power cord 105 is connected to the cord connection 11B of the sheet metal drawing equipment 1 and a clamp-type connector 100 mounted on the other end of the power cord 105 is connected to an electrode 150 on an output side of a stud welding machine (not shown).

Figure 12:
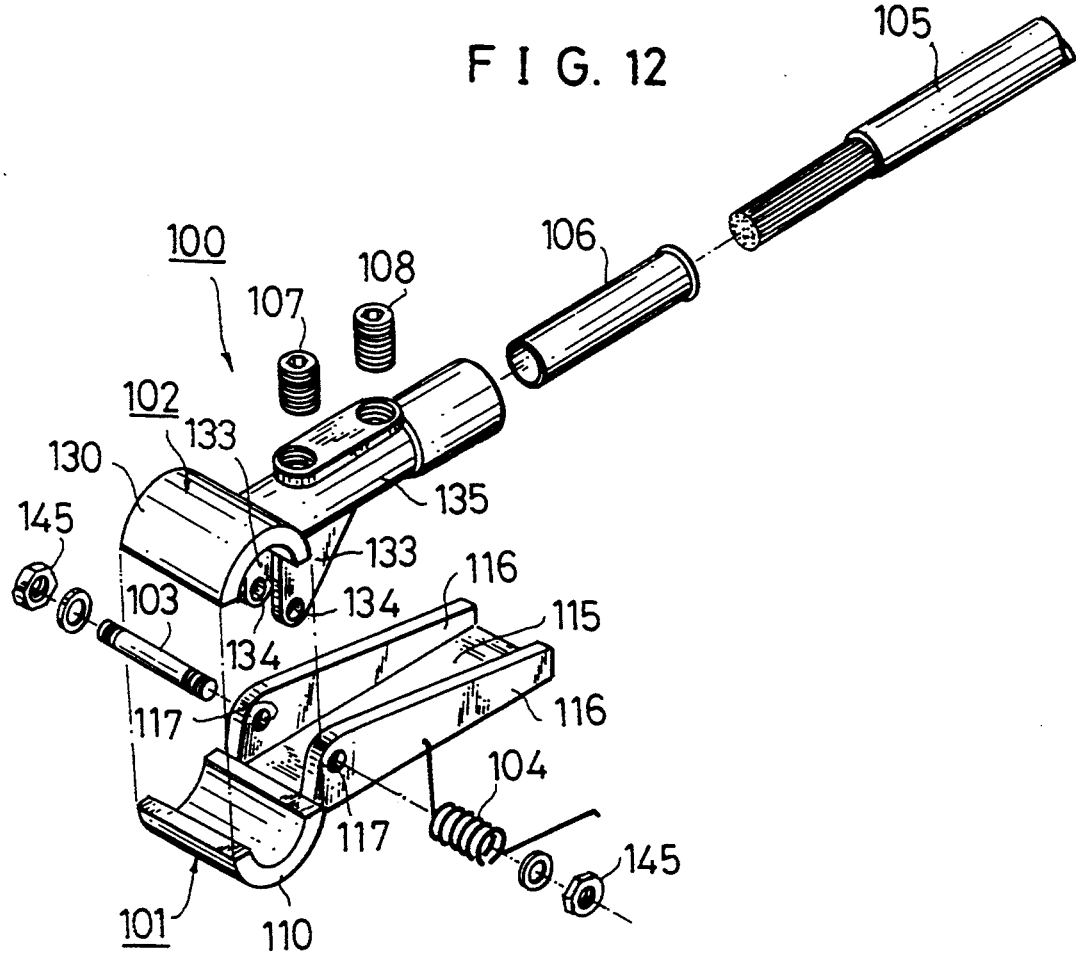
FIG. 12 is an exploded perspective view showing an example of a clamp-type connector which may be connected to the sheet metal drawing equipment of FIG. 4.

Referring now to FIG. 12, an example of the clamp-type connector 100 is illustrated. A clamp-type connector of FIG. 12 includes a first clamp means 101 and a second clamp means 102 pivotally mounted on the first clamp means 101. The first and second clamp means 101 and 102 are pivotally connected together by means of a pin 103. The pin 103 is fitted thereon with a coil portion of a coiled spring 104 for biasing a distal end of the second clamp means 102 against a distal end of the first clamp means 101. To the second clamp means 102 is fixedly connected a cord 105.

The first clamp means 101 includes a first clamp section 110 constituting the distal end of the clamp means 101 and a first grip section 115 constituting a proximal end of the clamp means 101. The first grip section 115 is formed on each of side walls thereof with a bearing hole 117 for supporting the pin 103 therein. The second clamp means 102 includes a second clamp section 130 constituting the distal end of the clamp means 102, a pair of rising elements 133 each arranged in proximity to the second clamp section 130 and formed with a through-hole 134 so as to be aligned with the through-holes 117 of the first grip section 115 to permit the pin 103 to be inserted therethrough, and a second grip section 135 forming a proximal end of the clamp means 102. In the illustrated embodiment, the rising elements 133 are arranged on an inside of the second grip section 135 so as to inward extend therefrom. The first and second clamp sections 110 and 130 cooperate with each other to form a clamper.

In FIG. 12, reference numeral 106 designates a pipe for guiding the end of the cord 105, and 107 and 108 each are a screw for fixing the cord 105 to the second clamp means 102. Reference numeral 145 is a nut.

Now, the manner of operation of the sheet metal drawing equipment 1 of the illustrated embodiment constructed as described above will be described hereinafter.

Figure 14:
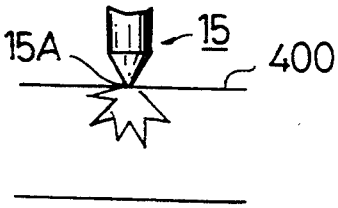
FIG. 14 is a schematic front elevation view of the bit shown in FIG. 13, which is being welded to the sheet metal material.

First, the legs 91 and 92 of the leg means 90 which has been selected depending on a position of a surface portion of a sheet metal material to be drawn or repaired, its size, its configuration and the like are mounted on the arm portions 33A and 33B of the arm beam of the main lever 30 by means of the screws 96 and 97. Then, a degree of threaded insertion of each of the stopper 70 and grip width adjusting bolt 80 through the through-hole is adjusted to set the grip width L to a dimension suitable for an operator. Then, the leg means 90 is abutted against a surface 400 of a sheet metal material so as to permit a contact surface 99 of the cushion member 98 to surround the portion of the sheet metal material to be drawn or repaired and then the handle 11 is rotated, so that the threads formed on the central through-holes 52 of the support member 51 permit the shaft 12 to be moved in an axial direction thereof while rotating it. This causes the bit 15 to be lowered by a distance sufficient to permit a tip end 15A of the bit 15 to reach a bottom of a depression of the repaired surface portion 400. For example, the distance is defined to be a depth M in FIG. 6. Then, a switch of a stud welding machine (not shown) is turned on to cause a current to flow from the power cord 105 through the shaft 12 to the bit 15, resulting in the tip end 15A of the bit 15 being welded to the depression as shown in FIG. 14. The welding operation is carried out while flowing a current in an amount sufficient to permit the tip end 15A of the bit 15 to be welded to the surface 400 of the sheet metal material in a short period of time as small as, for example, about 0.8 second after short-circuiting between the tip end 15A of the bit 15 and the surface 400 of the sheet metal material due to abutment therebetween.

Figure 13:
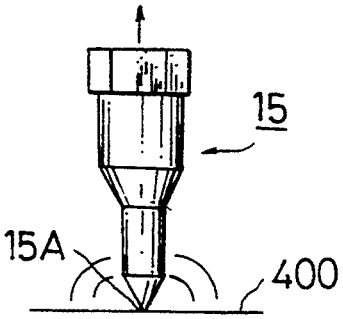
FIG. 13 is a schematic front elevation view showing a bit which is arranged at a distal end of the sheet metal drawing equipment of FIG. 4 and which is ready to be welded to a surface of a sheet metal material to be drawn.

Then, the second operation means 20 is manually gripped to slowly pull up the second lever 40 against the coiled compression coil 14, so that the second lever 40 may be pivotally moved about the bolt 46 to raise the shaft 12 through the support member 51. This results in the bit 15 fixed on the distal end 12B of the shaft 12 slowly lifting the depression of the surface 400 of the sheet metal material, as shown in FIG. 13. At this time, the support member 51 is raised while being inclinedly moved about the bolts 48 and 49 in relation to the second lever 40, whereas the shaft 12 is axially moved while being guided via the through-hole 34 of the main lever 30.

Figure 15:
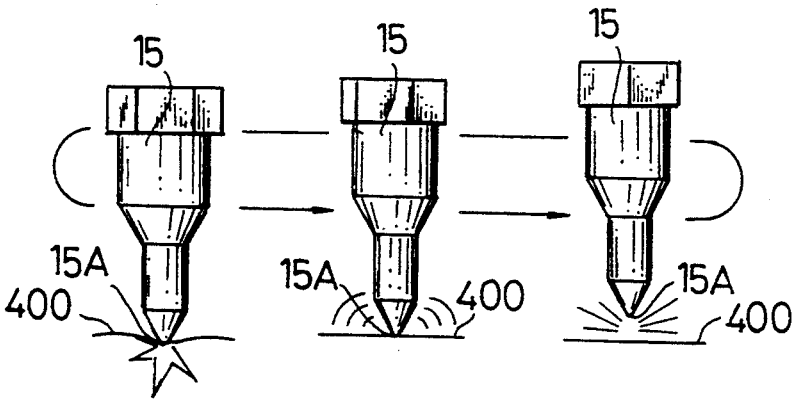
FIG. 15 is a front elevation view showing a process of sheet metal drawing which comprises a welding step, a drawing step and a separating step and is carried out by means of the bit shown in FIG. 13.

Then, it is carried out to confirm that the surface 400 of the sheet metal material is smoothed or flattened and then the second lever 40 is loosened followed by rotating the handle 11 to separate the tip end 15A of the bit 15 from the surface 400 of the sheet metal material. A series of operations comprising the above-described welding, drawing and separation are shown in FIG. 15. The bit 15 is transferred in order in an area of the sheet metal material to be repaired, to thereby repeat the operations, resulting in the sheet metal drawing being carried out on the whole area.

Figure 16:
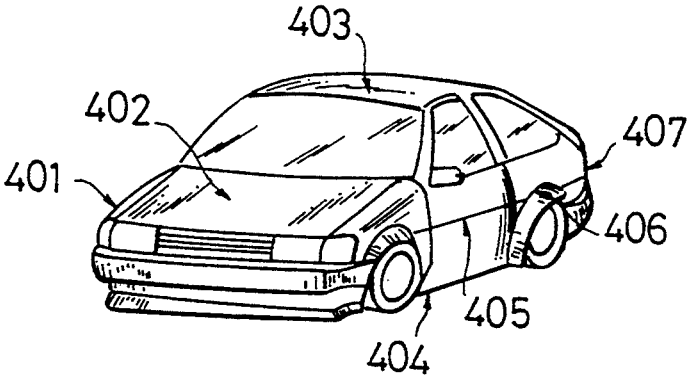
FIG. 16 is a schematic perspective view showing an example of a car.
Figure 17:
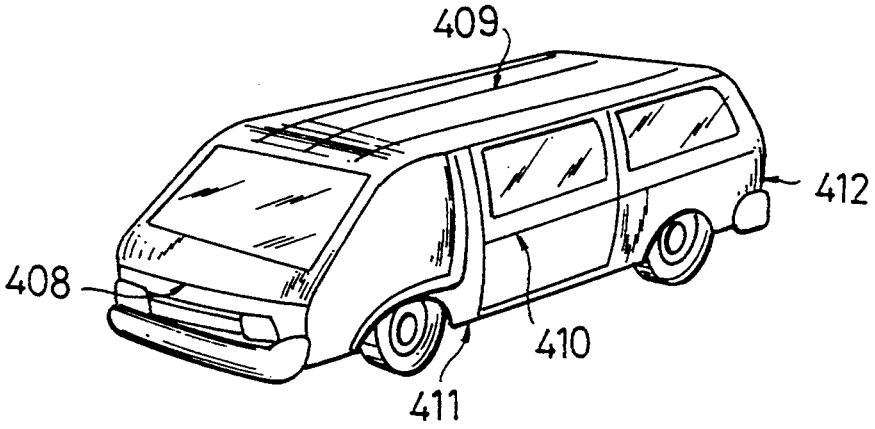
FIG. 17 is a schematic perspective view showing another example of a car.

The sheet metal drawing equipment 1 of the illustrated embodiment may be combined with a stud welding machine provided with an automatic welding function to continuously carry out welding of the bit and drawing. Thus, when an object which is to be subject to sheet metal drawing is a body of a car, the equipment of the illustrated embodiment may be applied to any desired position on the body, as indicated at reference numerals 401 to 412 in FIGS. 16 and 17. More specifically, the equipment may be satisfactorily applied to full repairing of a fender 401 (FIG. 16) which tends to be frequently subject to repairing, a plane section hard to be repaired such as a bonnet 402 (FIG. 16), a section having an inner liner applied thereto such as a ceiling 403 (FIG. 16), and the like. Also, it is effectively applicable to smoothing of a hard step 404 (FIG. 16) which has been subject to rough drawing. Further, it can form a line 405 (FIG. 16) on a door without peeling an inner liner from the door because of eliminating a necessity of tapping against an inner surface of the door and facilitate repairing of a hard bag-like fender arch 406 (FIG. 16). In addition, it can repair a position which is hard to be accessed such as a corner 407 (FIG. 16) and repair a dash board 408 (FIG. 17) of a front panel of a cab-type car without removing interior goods. Furthermore, it facilitates an operation on an elevated place such as a roof 409 (FIG. 17) because it is constructed in a compact manner. Moreover, it may be used for repairing such portions as indicated at reference numerals 410 to 412 in FIG. 17.

Figure 18:
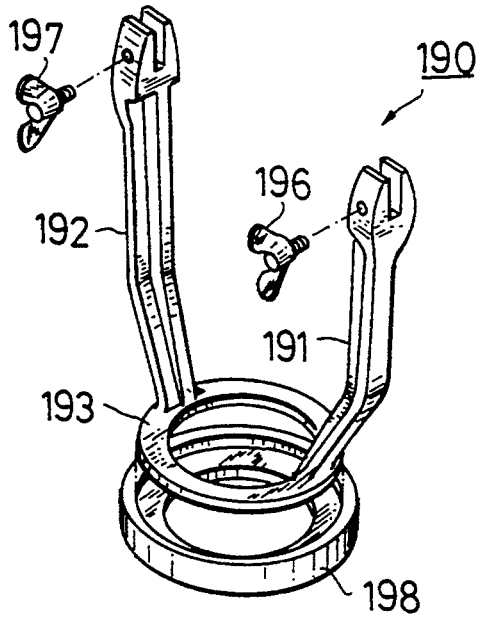
FIG. 18 is a perspective view showing a modification of a leg means of the sheet metal drawing equipment of FIG. 4.
Figure 19:
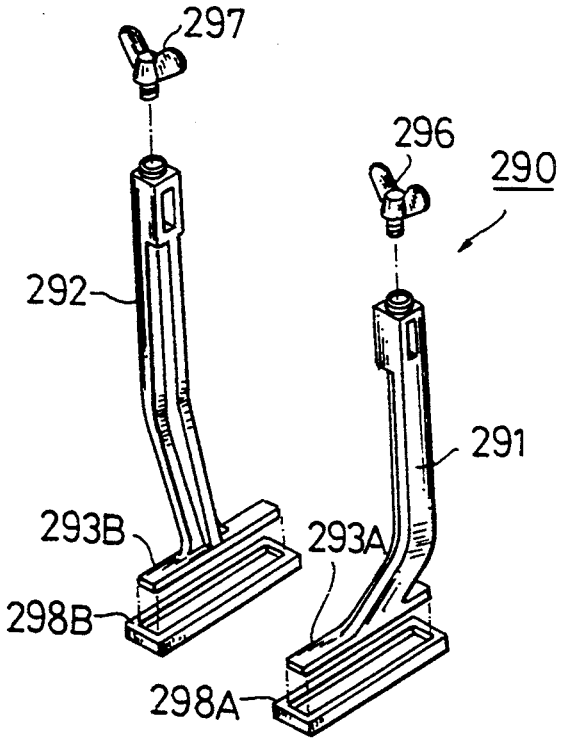
FIG. 19 is a perspective view showing another modification of a leg means of the sheet metal drawing equipment of FIG. 4.

In the illustrated embodiment, the contact member and cushion member of the leg means, as described above, each are formed into a rectangularly annular shape or hollow rectangular shape. Alternatively, they may be formed in such a manner as shown in FIG. 18. In FIG. 18, a contact member and a cushion member which are designated at reference numerals 193 and 198, respectively, each are formed into a circularly annular or hollow circular shape. The leg means of which the contact member is formed into a rectangularly annular shape is suitably applied to sheet metal drawing with respect to a flat portion of a sheet metal material such as a door of a car, its bonnet, its roof, its trunk or the like; whereas the contact member of a circularly annular shape is suitable for sheet metal drawing with respect to a corner portion such as a tail of a car, its trunk, its front or the like. In FIG. 18, reference numerals 191 and 192 each designate a leg and 196 and 197 each are a wing bolt. FIG. 19 shows another modification of the leg means, wherein legs 291 and 292 of a leg means 290 are formed separate from each other, contact members 293A and 293B each are formed into an elongated shape, and cushions 298A and 298B each are formed into a rectangular frame-like shape. The leg means 290 thus constructed is suitably applied to sheet metal drawing with respect to a groove-like damage such as a scratch, a wound or the like; a damage on a limited portion; and the like. In FIG. 19, reference numerals 296 and 297 each designate a wing bolt.

Figure 20C:
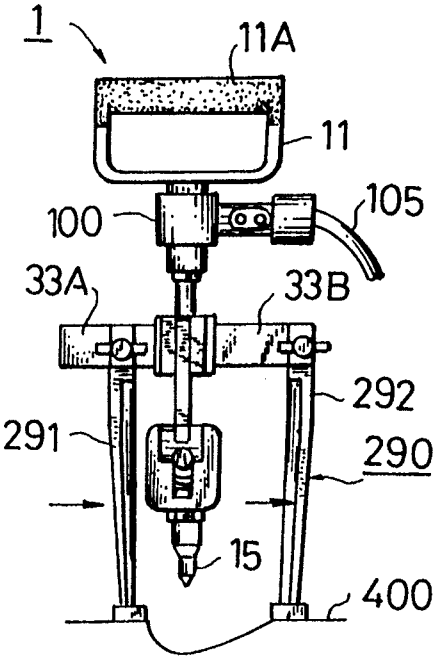
FIGS. 20A to 20F each are a schematic front elevation view showing the manner of operation of the sheet metal drawing equipment shown in FIG. 4.
Figure 20B:
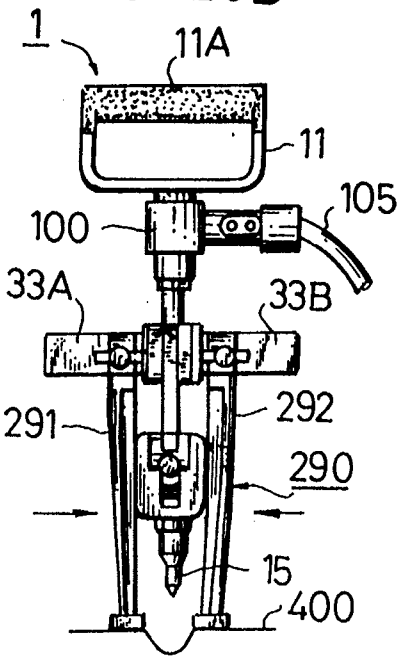
Figure 20A:
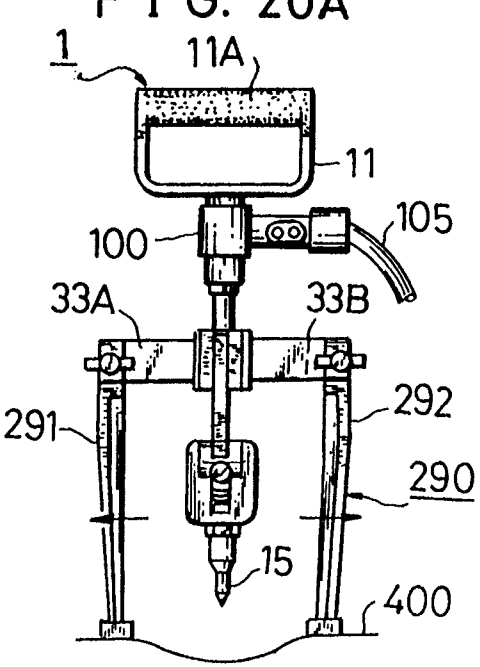
Figure 20F:
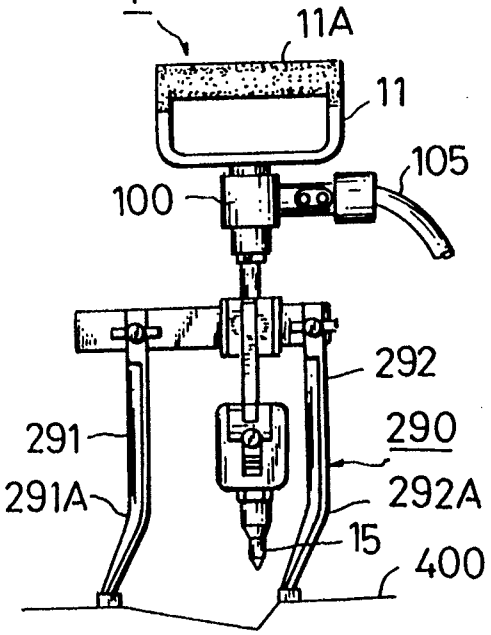
Figure 20E:
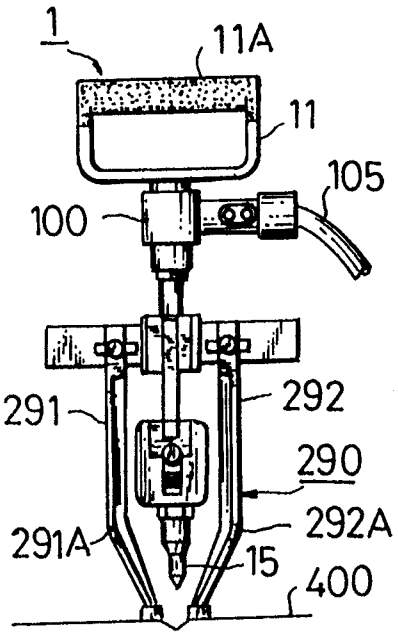
Figure 20D:
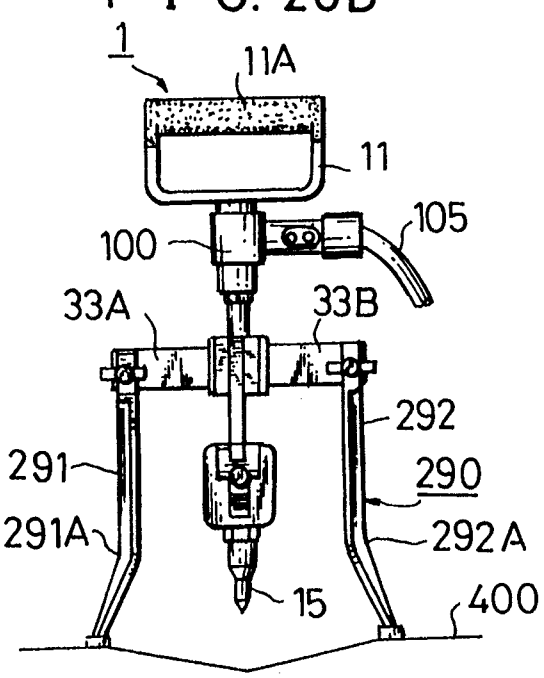
Figure 21:
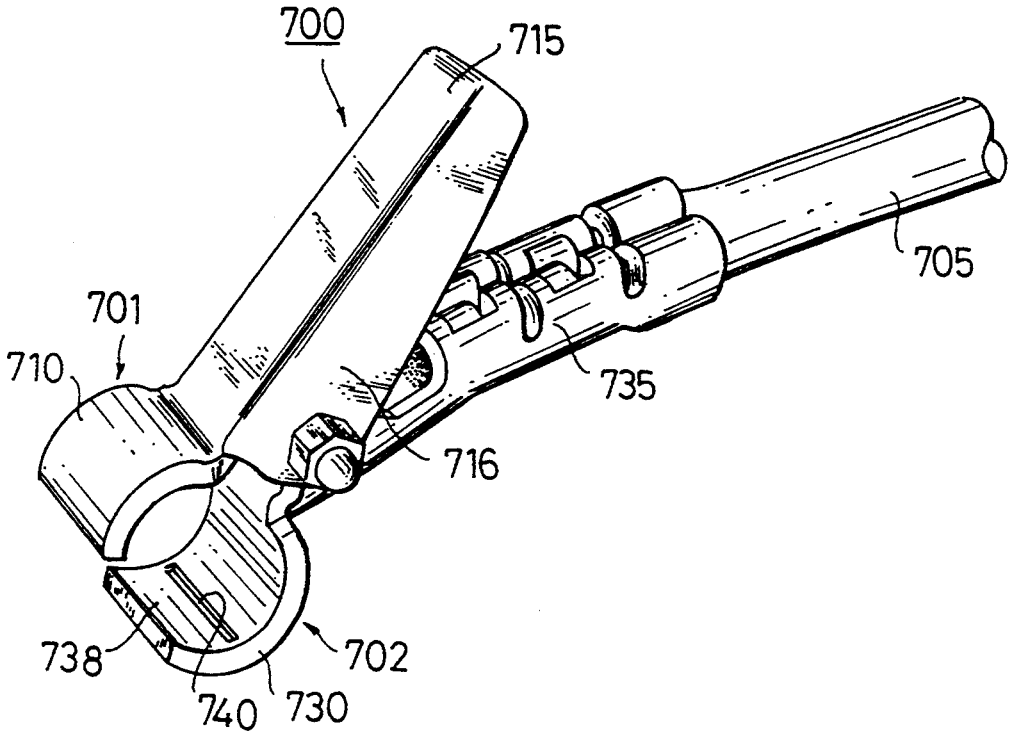
FIG. 21 is a perspective view showing another example of a clamp-type connector.
Figure 22:
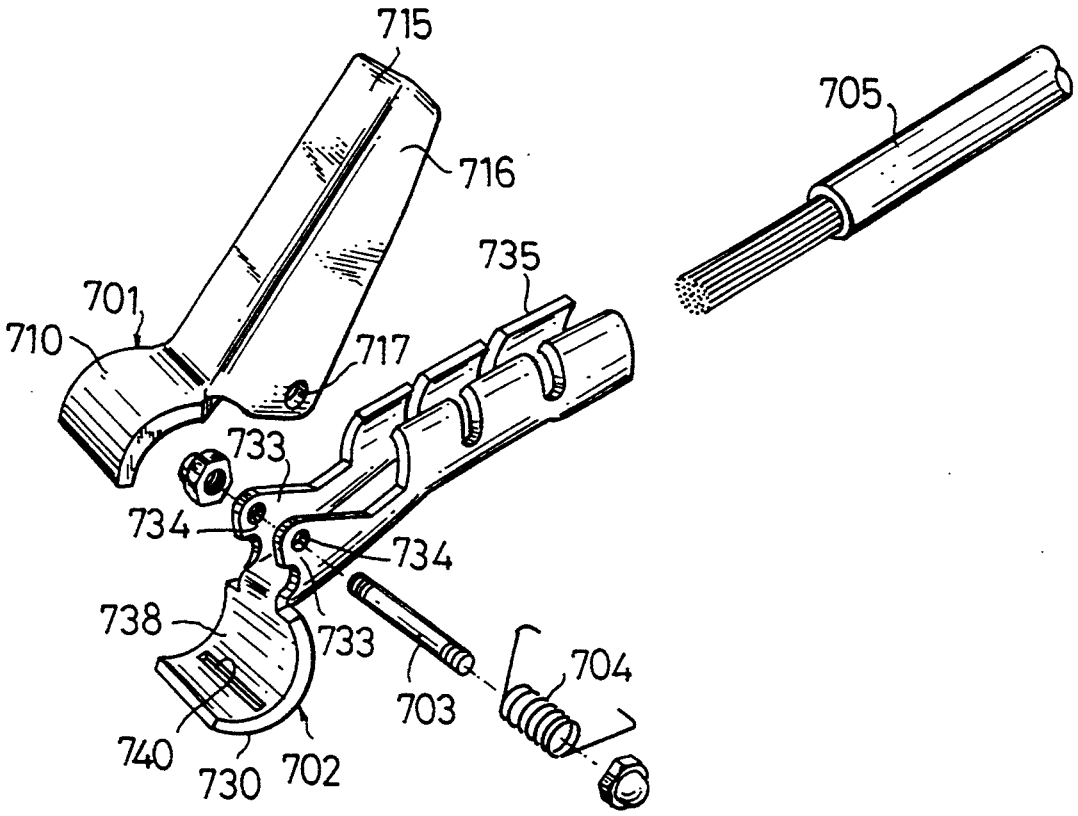
FIG. 22 is an exploded perspective view of the clamp-type connector showing components of the connector.
Figure 23:
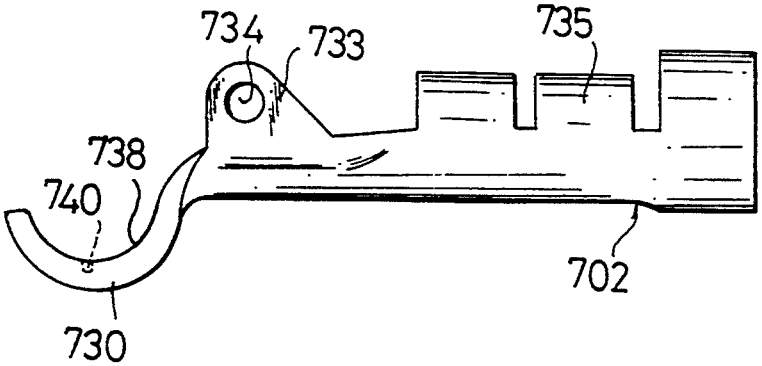
FIG. 23 is a front elevation view showing a second clamp means of the clamp-type connector shown in FIG. 21.
Figure 24:
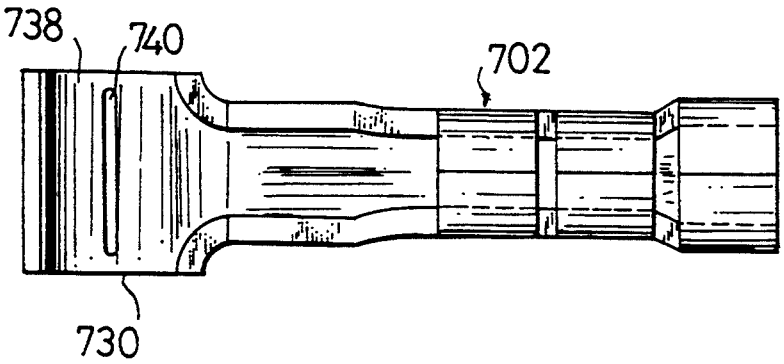
FIG. 24 is a plan view of the second clamp means shown in FIG. 23.
Figure 25:
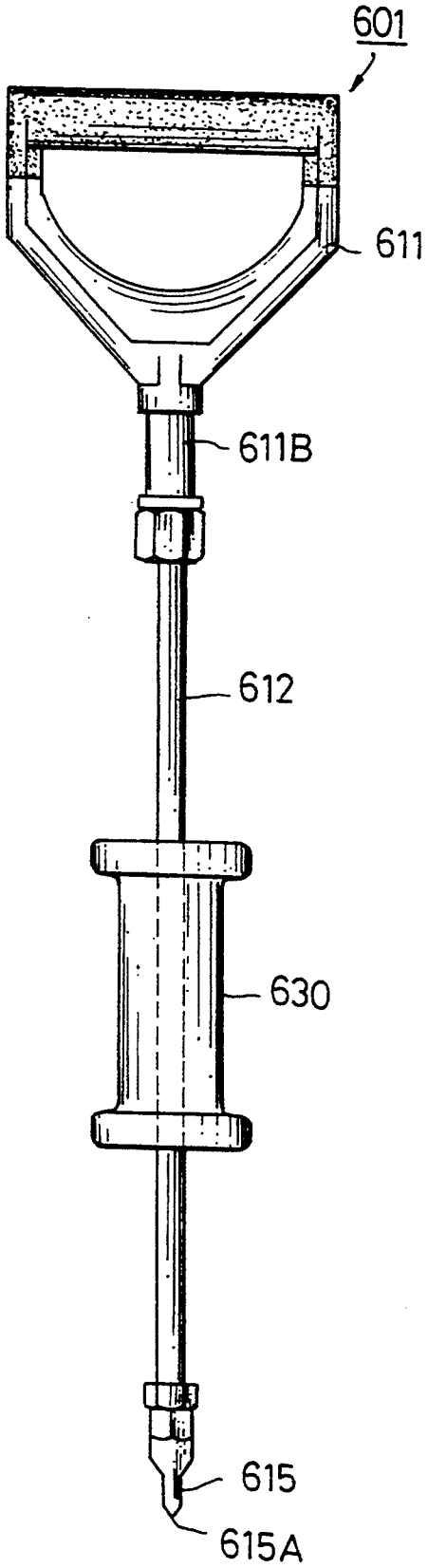
FIG. 25 is a front elevation view showing another embodiment of a sheet metal drawing equipment according to the present invention.
Figure 26:
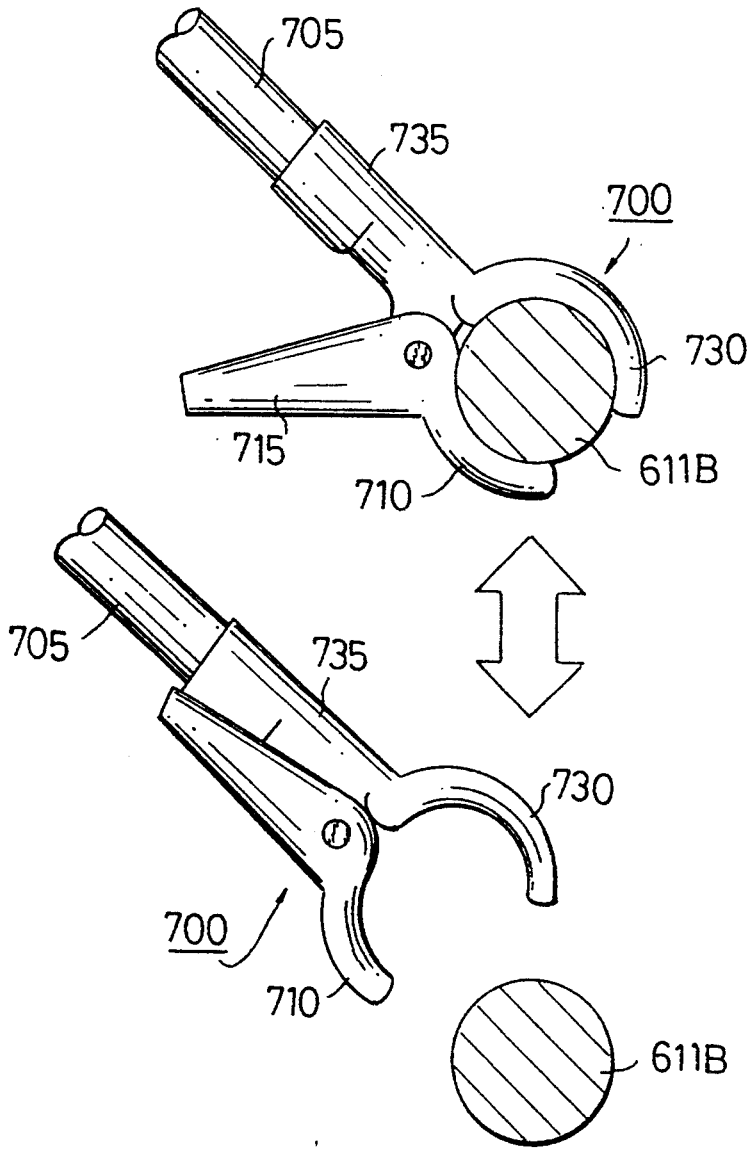
FIG. 26 is a fragmentary schematic view partly in section showing the manner of connection and disconnection of the sheet metal drawing equipment of FIG. 25 with respect to the clamp-type connector of FIG. 21.

The leg means 290 shown in FIG. 18 may be operated in a manner to move both legs 291 and 292 independent from each other, as shown in each of FIGS. 20A to 20C. More particularly, sheet metal drawing with respect to a damage of an increased area is carried out by displacing the legs 291 and 292 in a direction apart from each other to increase an interval therebetween. A damage of a small area may be subject to sheet metal drawing while approaching both legs to each other to decrease the interval. Also, a configurationally biased damage of which a configuration is biased or a positionally biased damage of which a position is biased can be repaired by positioning the bit 15 opposite to the deepest portion of the damage and laterally displacing both legs 291 and 292. Alternatively, the leg means 290 may be so formed that the legs 291 and 292 are formed at intermediate portions thereof with bent portions 291A and 292A, as shown in each of FIGS. 20D to 20F. In the leg means 290 thus constructed, a change in a position at and/or a direction in which the legs 291 and 292 are connected to the arm sections 33A and 33B permits the equipment to be accommodated to various positional, configurational and dimensional requirements of an damaged sheet metal material to be repaired.

In order to permit sheet metal drawing to be satisfactorily carried out irrespective of a configuration of a damage to be repaired, its size and its position, it is preferable to prepare a plurality of leg means different in configuration and size of the contact member from each other.

Also, the sheet metal drawing equipment of the illustrated embodiment may be applied to a projected damage as well as a depressed damage. For example, when a portion of an iron sheet material to be repaired is excessively extended to form a projection or a projection is produced on a sheet metal material due to excessive sheet metal drawing, the production thus formed may be repaired by welding the tip end of the bit to the projection by means of a stud welding machine, instantaneously heating the welded portion and operating the handle and shaft to press the bit against the projection, to thereby smooth the projected portion.

Referring now to FIGS. 21 to 24, another example of the clamp-type connector is shown. A clamp-type connector of FIGS. 21 to 24 may be constructed in substantially the same manner as the connector described above with reference to FIG. 12, except a construction described hereinafter. More specifically, the clamp-type connector generally designated at reference numeral 700 generally includes a first clamp means 701, a second clamp means 702, a shaft or pin 703 for pivotally supporting the first and second clamp means 701 and 702, and a spring 704. The second clamp means 702 includes a second clamp section 730 forming a distal end portion of the clamp means 702, a pair of rising elements 733 provided in proximity to the second clamp section 730 and formed with holes 734 through which the pin 703 is inserted, and a second grip section 735 constituting a proximal end portion of the clamp means 702. The rising elements 733 are arranged so as to be interposed between the second clamp section 730 and the second grip section 735. A cord 705 is inserted at one end thereof into the second grip section 735 and fixed thereto by caulking the second grip section 735. The first clamp means 701 includes a first clamp section 710 constituting a distal end portion of the first clamp means 701 and a first grip section 715 forming a proximal end portion of the first clamp section 701. The first grip section 715 includes side walls 716 formed with holes 717 through which the pin 703 is inserted. The holes 717 are provided so as to be aligned with the holes 734. Thus, the distal end portions of the first clamp means 701 and second clamp means 702 cooperate with each other to form a clamper. The clamp-type connector 700 shown in FIGS. 21 to 24 is different from the clamp-type connector 100 shown in FIG. 12 in that the clamper is provided on an inner surface 738 thereof with an oil groove 740 for storing therein oil used to ensure smooth pivotal movement of the clamper. Such construction permits smooth pivotal movement of the clamp means to be ensured, to thereby prevent damage to the connector.

Referring now to FIGS. 25 to 28, another embodiment of a sheet metal drawing equipment of the present invention is shown, which is adapted to be combined with the clamp-type connector 700 described above. A sheet metal drawing equipment of the illustrated embodiment generally designated at reference numeral 601 is provided at a distal end thereof with a bit 615 weldable to a surface of a sheet metal material to be drawn and at a proximal end thereof with a handle 611. The equipment 601 also includes a shaft 612 rotated by operating the handle 611 and a slide hammer 630 mounted on the shaft 612. The clamp-type connector 700 described above, as shown in FIG. 26, is detachably connected to a cord connection 611B interposedly arranged between the handle 611 and the shaft 612.

Figure 27A:
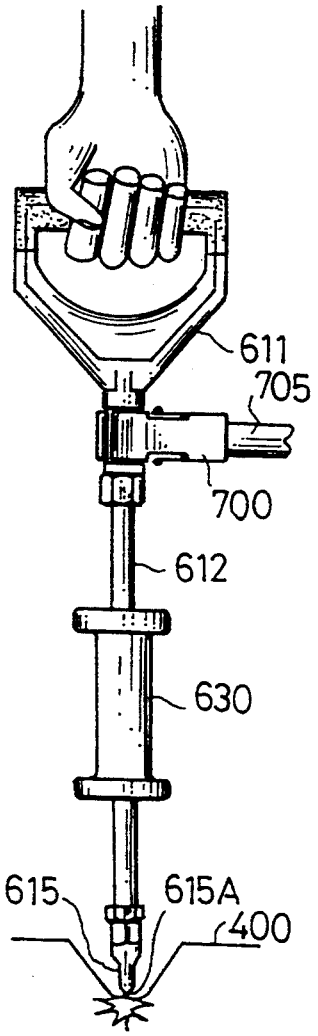
FIGS. 27A to 27C each are a front elevation view showing an example of the manner of operation of the sheet metal drawing equipment shown in FIG. 25.
Figure 27B:
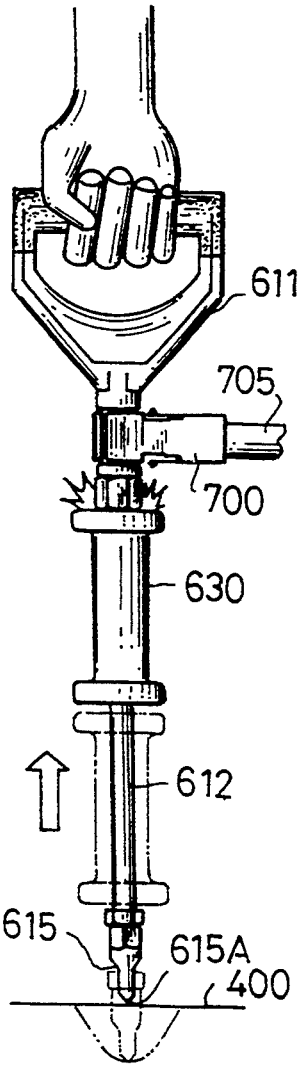
Figure 27C:
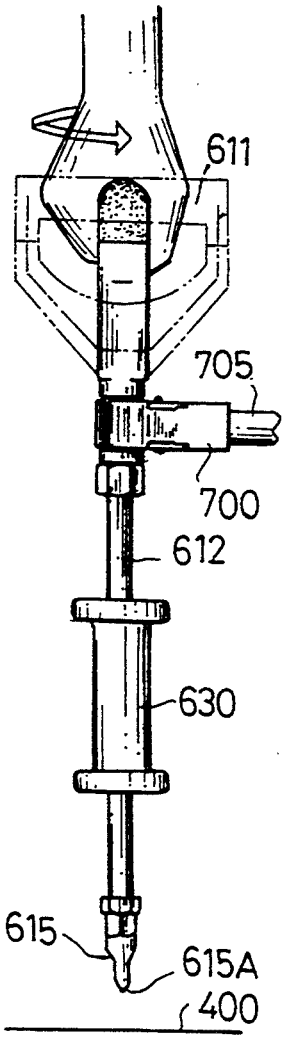
Figure 28A:
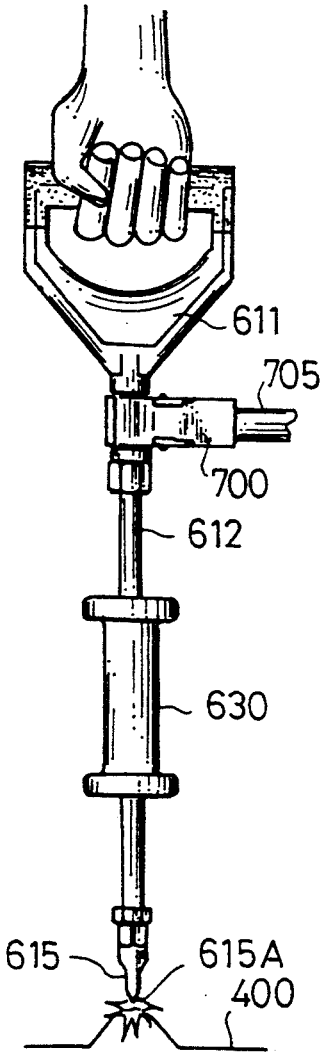
FIGS. 28A to 28C each are a front elevation view showing another example of the manner of operation of the sheet metal drawing equipment shown in FIG. 25.
Figure 28B:
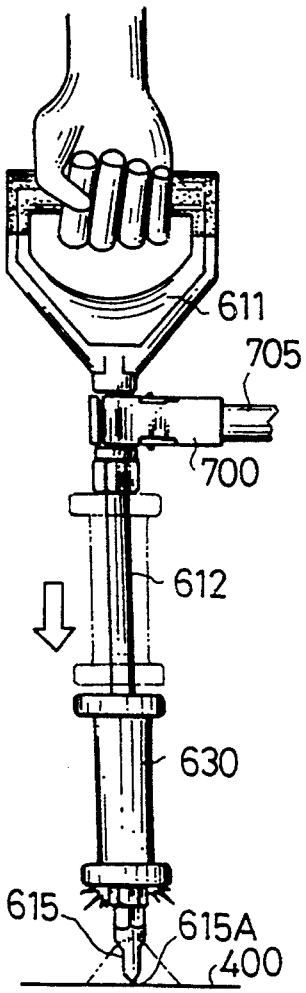
Figure 28C:
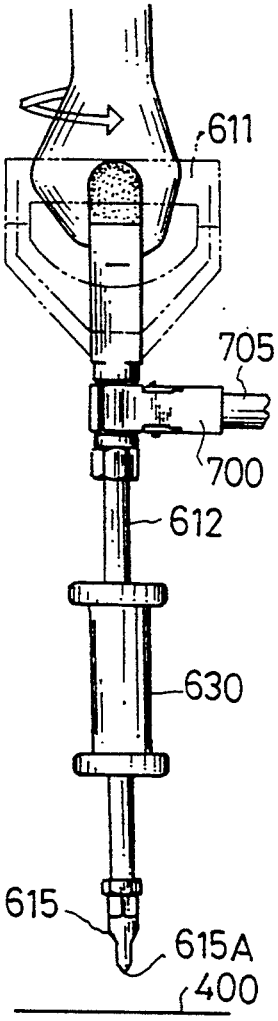

Now, the manner of operation of the sheet metal drawing equipment 601 will be described. A stud welding machine (not shown) is turned on to weld a tip end 615A of the bit 615 to a depression on a surface 400 of a sheet metal material to be drawn, as shown in FIG. 27A. Then, the slide hammer 630 is upward slid along the shaft 612 to be struck against a collar provided at an upper portion of the shaft 612, to thereby draw the depression of the surface 400, as shown in FIG. 27B. This results in the surface 400 of the sheet metal material being smoothed. Thereafter, the handle 611 is rotated, to thereby separate the tip end 615A of the bit 615 from the sheet metal material smoothed, as shown in FIG. 27C. Elimination of a projection formed on a surface 400 of a sheet metal material may be carried out in such a manner as shown in FIGS. 28A to 28C.

Thus, it will be noted that the sheet metal drawing equipment of the illustrated embodiment adapted to be used in combination with the clamp-type connector 700 permits connection of the cord to the equipment to be carried out in a one-touch operation. Also, the equipment permit the clamp means of the connector to be freely rotated while being mounted on the equipment, to thereby ensure optimum positioning of the equipment as desired. Also, electrical connection between the equipment and a power supply is attained through the connector, to thereby not only ensure stable electrical contact and minimize damage to the cord but reduce fatigue of the connector because of permitting pivotal movement of the clamp means of the connector in use. Further, a connection portion of the clamp means connected to the equipment is increased in width, resulting in electrical contact between the equipment and the connector being satisfactorily ensured with high reliability.

As can be seen from the foregoing, the sheet metal drawing equipment of the present invention accomplishes sheet metal drawing through a series of steps comprising welding of the bit to a sheet metal material, drawing and separation of the bit from the material, so that sheet metal drawing may be rapidly and positively carried out with high efficiency without skill and smoothing of the sheet material may be facilitated.

Also, the equipment of the present invention permits the second operation means to be manually operated while welding the tip end of the bit to a surface of a sheet metal material, so that drawing may be carried out while finely adjustably applying force to the surface depending on a configuration of the surface to be drawn, its size and the like.

Further, the equipment of the present invention is so constructed that the first operation means is rotatably supported on the support section of the second operation means and rotation of the handle of the first operation means permits the bit to be vertically moved, to thereby freely adjust a position of the bit depending on a depth of a depression on a surface of a sheet metal material as desired. Such construction permits a degree of drawing to be suitably preset before the drawing operation, resulting in the drawing operation being accurately carried out. Also, an operator carries out sheet metal drawing while viewing manual operation of the second operation means, so that the drawing operation may be highly facilitated.

Moreover, the sheet metal drawing equipment of the present invention permits a degree of welding of the bit to a front surface of a sheet metal material to be significantly reduced, to thereby substantially prevent scorching on a rear surface of the sheet metal material due to welding of the bit and permit drawing of a depression on the front surface to be slowly carried out, resulting in preventing metal fatigue of a portion of the sheet metal material which has been repaired.

While preferred embodiment of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A sheet metal drawing equipment comprising:

a first operation means provided at a distal end thereof with a bit weldable to a surface of a sheet metal material to be drawn, including a shaft formed with threads and a handle provided on one end of said shaft for rotating said shaft, said bit is fixedly mounted on a distal end of said shaft;

a second operation means including a support section for rotatably supporting said first operation means and manually operated to pull up said first operation means, said support section is formed with a first threaded through-hole via which said threads of said shaft are threadedly inserted; and a leg means for supporting said second operation means, said leg means is provided with a contact surface abutted against the surface of the sheet metal material.

2. A sheet metal drawing equipment as defined in claim 1, wherein said second operation means includes a main lever, a second lever and a connection arm for connecting said main lever and second lever to each other therethrough.

3. A sheet metal drawing equipment as defined in claim 2, wherein said main lever is stationarily arranged;

said second lever is pivotally supported at one end thereof on said connection arm and provided at the other end thereof with a handgrip; and said support section is inclinably supported in an intermediate portion of said second lever.

4. A sheet metal drawing equipment as defined in claim 3, wherein said shaft is fittedly mounted thereon with a coiled compression spring in a manner to be interposed between said main lever and said second lever to urge said second lever;

said second lever being pulled up against said coiled compression spring to carry out drawing of the surface of the sheet metal material.

5. A sheet metal drawing equipment as defined in claim 4, wherein said second operation means includes a grip width adjusting means arranged between said connection arm and said second lever for adjusting a grip width between said main lever and said second lever.

6. A sheet metal drawing equipment as defined in claim 5, wherein said grip width adjusting means comprises a second threaded through-hole formed through said connection arm and a first bolt threadedly fitted in said second threaded through-hole and abutted at one end thereof against said second lever.

7. A sheet metal drawing equipment as defined in claim 5, wherein said main lever is provided with a stopper for regulating movement of said second lever.

8. A sheet metal drawing equipment as defined in claim 7, wherein said stopper includes a third threaded through-hole formed through said main lever and a second bolt threadedly inserted via said third through-hole and abutted at one end thereof against said second lever.

9. A sheet metal drawing equipment as defined in claim 3, wherein said main lever includes a support beam for fixing said leg means.

10. A sheet metal drawing equipment as defined in claim 9, wherein said leg means includes an annular contact member, a pair of legs arranged on said contact member so as to upward extend therefrom, and a cushion member made of an elastic material and mounted on said contact member so as to be abutted against the surface of the sheet metal material.

11. A sheet metal drawing equipment as defined in claim 10, wherein said contact member and cushion member each are formed into a rectangularly annular shape.

12. A sheet metal drawing equipment as defined in claim 10, wherein said contact member and cushion member each are formed into a circularly annular shape.

13. A sheet metal drawing equipment as defined in claim 10, wherein said legs each are formed with a bent portion, so that a distance between said legs at a lower portion thereof is defined to be small as compared with that at an upper portion thereof.

14. A sheet metal drawing equipment as defined in claim 9, wherein said leg means includes a pair of contact members formed into a shape like a flat plate, legs arranged on said contact members so as to upward extend therefrom, and cushion members made of an elastic material and mounted on said contact members so as to be abutted against said surface of said sheet metal material.

15. A sheet metal drawing equipment as defined in claim 14, wherein said legs each are formed with a bent portion; and a direction in which said legs are connected to said support beam is reversibly changed.

16. A sheet metal drawing equipment as defined in claim 9, wherein said main lever is formed with a shaft inserting through-hole via which said shaft is inserted.

17. A sheet metal drawing equipment as defined in claim 9, wherein said shaft is provided with a connection section for connecting an output cord of a welding machine therethrough to said shaft.

18. A sheet metal drawing equipment as defined in claim 17, wherein said handgrip of said second lever is covered with an insulating material; and said main lever is provided with a handgrip and said handle is provided with a grip, said handgrip of said main lever and said grip of said handle being covered with an insulating material.

19. A sheet metal drawing equipment, as defined in claim 1, further comprising:

a clamp-type connector including a first clamp means, a second clamp means pivotally connected to said first clamp means, a spring for urging a distal end of said second clamp means toward a distal end of said first clamp means, and a cord connected to one of said first clamp means and second clamp means, said distal ends of said first and second clamp means cooperating with each other to form a clamper, through which said clamp-type connector is detachably connected to said connection section of said first operation means.

20. A sheet metal drawing equipment as defined in claim 19, wherein said clamp-type connector further includes a pin for pivotally supporting said first clamp means and second clamp means.

21. A sheet metal drawing equipment as defined in claim 19, wherein said clamper is provided on an inner surface thereof with an oil groove in which oil is stored for ensuring smooth pivotal movement of said clamper.

22. A sheet metal drawing equipment as defined in claim 19, wherein said first clamp means includes a first clamp section forming a distal end of said first clamp means and a first grip section forming a proximal end of said first clamp means, said first grip section being formed with bearing holes for supporting said pin; and said second clamp means includes a second clamp section forming a distal end of said second clamp means, a pair of rising elements arranged in proximity to said second clamp section and formed with pin inserting through-holes via which said pin is inserted, and a second grip section forming a proximal end of said second clamp means;

said first clamp section and second clamp section cooperating with each other to form a clamper.

23. A sheet metal drawing equipment as defined in claim 22, wherein said clamp-type connector is arranged at each of both ends of said cord.

* * * * *